United States Patent [19]

Cowan et al.

[11] Patent Number: 4,888,096

[45] Date of Patent: Dec. 19, 1989

[54] ROLL PRESS FOR REMOVING WATER FROM A WEB OF PAPER USING SOLID GROOVED ROLL AND COMPRESSED AIR

[75] Inventors: Wavell Cowan, Montpelier, Vt.; Stanley McGurk, Toronto, Canada

[73] Assignee: Inotech Process Ltd., LaSalle, Canada

[21] Appl. No.: 292,359

[22] Filed: Dec. 30, 1988

Related U.S. Application Data

[63] Continuation of Ser. No. 127,439, Dec. 2, 1987, abandoned, which is a continuation-in-part of Ser. No. 842,935, Mar. 24, 1986, abandoned, which is a continuation of Ser. No. 619,367, Jun. 11, 1984, abandoned, which is a continuation-in-part of Ser. No. 570,373, Jan. 13, 1984, abandoned.

[51] Int. Cl.[4] ..... D21F 3/02

[52] U.S. Cl. ..... 162/358; 162/206; 162/207; 100/176

[58] Field of Search ..... 162/206, 358, 359, 360.1, 162/207, 307; 100/116, 110, 176

[56] References Cited

U.S. PATENT DOCUMENTS

| | | | |
|---|---|---|---|
| 2,696,148 | 12/1954 | Hornbostel | 100/176 |
| 3,257,268 | 6/1966 | Wrist et al. | 162/358 |
| 3,284,285 | 11/1966 | Holden | 162/207 |
| 3,655,507 | 4/1972 | Nykopp | 162/358 |
| 3,657,069 | 4/1972 | Candor et al. | 162/206 |

*Primary Examiner*—Karen Hastings

*Attorney, Agent, or Firm*—Charles E. Brown; Charles A. Brown

[57] ABSTRACT

A paper machine includes a press section in which the paper web is carried along between a pair of paper machine felts. A dewatering apparatus is included in the press section which consists of a pair of opposed press rollers, one on either side of the felts, with the rollers forming a nip. The rolls are pressed toward each other to compress the felts and the paper web to the maximum mechanical compression. Compressed air is passed through one roller at the nip to the other roller which includes an exhaust device for draining the water blown through by the compressed air. The air is passed under pressure at the nip to evacuate water from the pores of the compressed felts and web. When the paper advances from the nip into an environment at atmospheric pressure, the paper web is substantially free of water.

3 Claims, 4 Drawing Sheets

35
100
22
23
20
24
22
11
10
21
31
11
32
30
33
34

200
80
63
70
90
40
67
64
61
50
62
60
68
66
65
50a

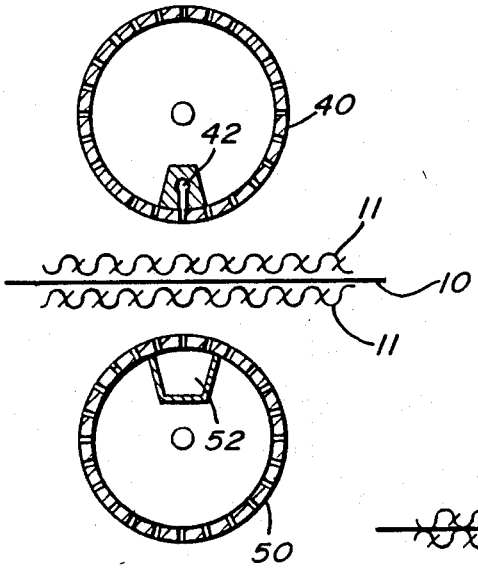
FIG. 3
FIG. 2
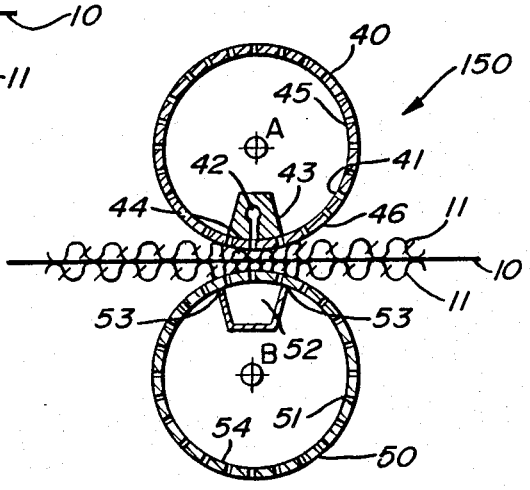
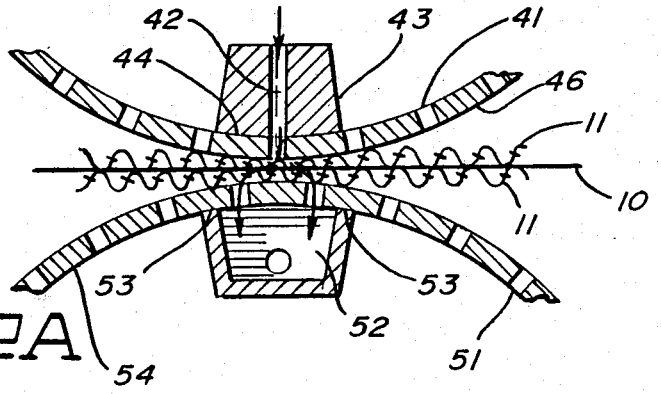
FIG. 2A
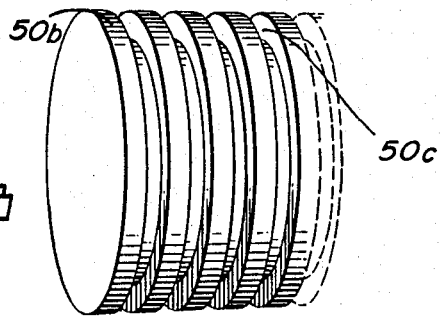
FIG. 2B

ROLL PRESS FOR REMOVING WATER FROM A WEB OF PAPER USING SOLID GROOVED ROLL AND COMPRESSED AIR

CROSS REFERENCE TO RELATED APPLICATIONS

This is a continuation application of application Ser. No. 127,439, filed Dec. 2, 1987, now abandoned which is a continuation-in-part application of application Ser. No. 842,935, filed Mar. 24, 1986, now abandoned, which is a continuation application of application Ser. No. 619,367, filed June 11, 1984, now abandoned, which is a continuation-in-part application of application Ser. No. 570,373, filed Jan. 13, 1984, now abandoned.

BACKGROUND OF THE INVENTION

1. Field of the Invention

The present invention relates to a method and apparatus for use in removing liquid from paper in the press section of a paper making machine.

2. Description of the Prior Art

In the manufacture of paper, after the paper sheet has been formed, it is subjected to mechanical compaction in order to express water therefrom. Water left in the sheet following final mechanical compaction must be removed by evaporative drying. The energy cost associated with the aforementioned evaporative drying is very high, in fact many times higher than is required for mechanical compaction.

The known apparatus for carrying out the aforementioned process in one instance comprises a press-plate adapted to squeeze a stationary formed sheet of paper and, in a further instance, a pair of press rollers arranged to squeeze a moving sheet of paper, i.e., a paper web. In both instances, a combination of felt and vacuum box are used to "receive" the expressed water.

Thus, in known wet pressing operations, as exemplified by the aforementioned static and dynamic systems, there are two essential elements present, i.e., means t apply a mechanical compacting load and means to "receive" water expressed from the wet sheet being compacted.

Either of the aforementioned systems, examined when the maximum compacting pressure has been applied to the wet sheet, will reveal the following picture.

The wet sheet has been compacted (reduced in thickness) so that, first, water has displaced air in all remaining spaces thus eliminating the air, and, second, the pore volume is reduced and thus only water remains in such pores. Under these conditions, the water content of the sheet will be that which is required to saturate (fill all available pores) the compressed sheet of paper; and this quantity of water will depend on the compacting pressure, the extent to which the paper sheet can be compressed (its wet compressibility properties), and in the dynamic case, the extent to which water has had the time to be forced out of the sheet.

Independent of all these details, however, it is possible to assign for any wet pressing operation the minimum residual water content the operation is capable of producing. It is the water content required to saturate the sheet when it has been compacted to the extent imposed by the wet pressing system.

This minimum theoretical water content is never achieved in current practice because in the process of removing the applied pressure, the paper sheet or web tends to suck water back from the felt or other reservoir as it expands. This phenomenon is well recognized, and steps have been taken to minimize this "rewetting". To the extent that these steps are successful, the wet pressing operation approaches the above indicated theoretical limit.

It is, therefore, an important aim of the present invention to provide an improved, more efficient apparatus to those presently available, being ones which will overcome the aforementioned disadvantages. Accordingly, it is a further important aim of the present invention to provide an apparatus which will enhance the water removal capability of a wet pressing operation.

SUMMARY OF THE INVENTION

The invention may be summarized as follows.

If under the conditions described above, where the maximum compression load has been applied and the compacted sheet being sandwiched between a pair of rolls is saturated with water, air is forced through the sheet, water will not only be expressed from the pores in the sheet, but water in the felt adjacent to the paper will also be expelled into the receiving chamber. The net result is that (a) at maximum compaction the water content of the sheet is less than the theoretical limitation which applies to all current wet pressing operations, and (b) by expelling water from felt adjacent to the paper sheet, the "rewetting" phenomenon is greatly reduced. The consequence is to significantly increase the amount of water removed from the sheet by the wet pressing operation and thus reduce the energy requirements of the subsequent evaporative drying process.

In a further aspect of the present invention, there is provided a method of removing liquid from compressible porous materials, including, for example, non-wovens and paper, comprising the steps of: extending a pair of felts or the like absorbent material to sandwich a web of the porous material containing the liquid; compressing the felts and the material containing the liquid at a nip; and passing a flow of gas at the nip of the rolls and the compressed porous material and felts and passing the same therethrough to remove liquid therefrom.

In a further aspect of the present invention, there is provided an apparatus for use in removing liquid from a compressible porous material comprising in combination: a first abutment, the abutment including a working surface having apertures therethrough; a second abutment including a working surface having apertures therethrough, the first and second abutments cooperatively arranged one to another whereby to receive therebetween the material and to compress the material, and means for introducing compressed gas to the apertures in either the first or second abutments for passage through the apertures in the first and second abutments when such are compressing the material.

In a further aspect of the present invention, there is provided an apparatus for use in removing liquid from a compressible porous material comprising a first roll including a working surface having apertures therethrough. A second roll includes a working surface having apertures therethrough. The first and second rolls are cooperatively arranged one to another to receive therebetween the material and to compress the material. Means are provided for introducing compressed gas to the apertures in either the first or second rolls for passage through the apertures in the first and second rolls at the nip when such are compressing the material. The apertures in at least one of the rolls comprise grooves which open toward the working surface thereof. The grooves extend circumferentially around the roller.

In a more specific embodiment in accordance with the present invention, the grooved rolls are provided with a sleeve having a plurality of apertures thereon communicating with the grooves. One of the rolls has a plurality of grooves which are parallel to the axis of the roll, and thus compressed air can be fed through the grooves from the ends of the rolls. The other roll, that is, the receiving roll, may be provided with circumferentially extending grooves covered by the perforated sleeve.

The phenomenon which occurs, particularly with the rolls described in the present specification, is explained as follows.

In the manufacture of paper, a pulp slurry consisting of approximately 1 lb. of pulp fiber per 100 lbs. or more of water is transformed into a sheet in which 1 lb. of fiber includes only .05 lb. of water. Almost 99 lbs. of the original 100 lbs. of water are removed by mechanical action including free drainage, vacuum drainage, air displacement drainage, and high pressure squeezing. The last pound or so of water must be removed by evaporation. Presently, it costs as much to remove this last pound of water as it does to remove the previous 99 lbs. Thus, there is a tremendous economic importance in delivering a wet paper web to the dryer section of a paper machine with the lowest possible water content.

The last mechanical operation currently employed by a modern paper machine in order to induce maximum water removal is to compress and thus squeeze water out of the sheet by carrying it through a loaded nip created by two press rolls. Presently, improvements have been directed to the felts to carry the paper web through the nip, and the design of the rolls has been improved in order to increase the efficiency of water removal. The result has been a beneficial improvement in general levels of dryness of the sheet delivered to the dryers, from earlier levels of 35 to 40% solids to current levels of 40 to 45% solids (i.e., 60 to 65% moisture content, to 55 to 60% moisture content). When a wet sheet of paper supported on a felt is passed through a press nip, it is compressed, at the nip, and the total load is the sum of the two rolls acting at the nip. Compression of the sandwich of the felt and paper will continue until air has been displaced and the water contained in the sandwich starts to "see" the load. When this happens, the water which is essentially incompressible, develops an internal pressure. This internal pressure causes water to flow out of the sandwich and thus relieves the pressure. For this reason, the pressure in the water contained in the sandwich decreases in some manner as the applied load is taken up more and more by the compressed structure and less and less by the water in the structure. When the compressed structure has been compressed to the extent that it absorbs the total load, then the water which remains in the compressed structure will carry no load and, therefore, contain no pressure and, therefore, cannot be removed. This, then, represents the ultimate, theoretical dewatering limit of the mechanical loading of paper.

The amount of water that will remain in the sheet is the water which saturates the fully compressed paper/felt sandwich under the maximum loading conditions that can be economically applied by the press.

According to the present invention, if air can be applied under suitable pressure in the nip during highly compressed conditions, the air will tend to push additional water out of a fully compressed sandwich. It is current practice to pass air through a web of paper. This is done in every paper machine, at the flat boxes, and at the suction couch roll. When air passes through the sheet under these conditions, it displaces more water. However, under these conditions, the amount of water that can be removed is very limited. What happens is that the water in large pores is displaced, and the air then leaks through these passages. Water in all the small pores remains unaffected. Passing air through a sheet does not, for this reason, achieve substantial dewatering.

It is essential for a high degree of mechanical loading to be applied to the paper web prior to applying air pressure. Under such conditions, the large pores in the paper are squeezed down so that the paper exhibits a much more uniform pore structure than when uncompressed. The applied air pressure will then empty sufficiently the more uniformly sized pores before it leaks through the emptied channels, so that significant dewatering will be achieved.

In other words, passing air through a sheet of paper has been demonstrated to have little dewatering effect. In the present invention, the novelty is to recognize that by highly compressing the paper web at the nip and then passing air therethrough changes the passage of air from an ineffective dewatering tool to a highly effective dewatering tool.

BRIEF DESCRIPTION OF THE DRAWINGS

The invention is illustrated by way of example in the accompanying drawings wherein:

FIG. 2 is a sectioned, elevational view showing a further embodiment in accordance with the present invention;

FIG. 2*a* is a sectioned, elevational view, similar to part of that shown in FIG. 2;

FIG. 2*b* is a fragmentary view of an alternative component to one shown in FIG. 2;

FIG. 3 is a further view of the embodiment shown in FIG. 2 with parts thereof displaced prior to compressing material, shown therebetween;

DESCRIPTION OF THE PREFERRED EMBODIMENTS

Figure 1:
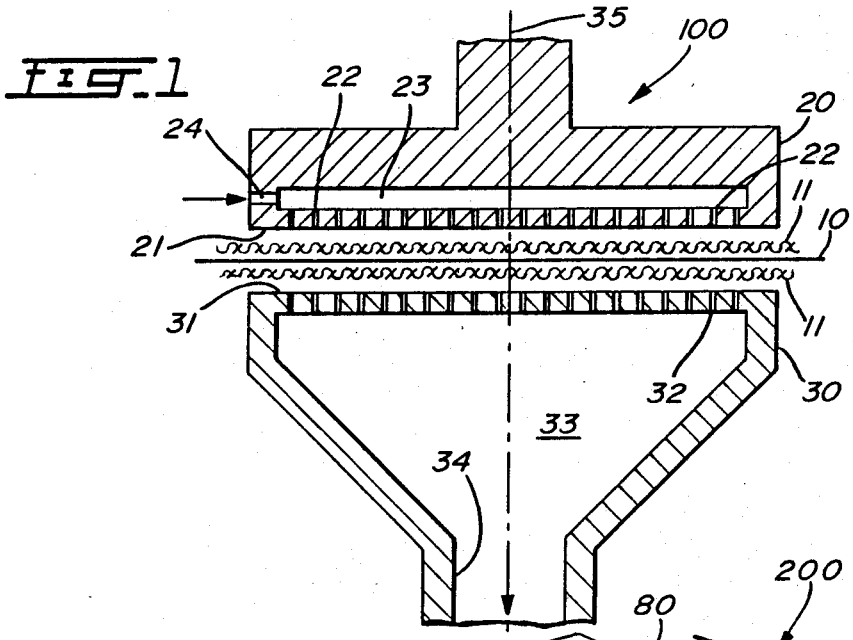
FIG. 1, appearing on the same sheet as FIG. 4, is a sectioned, elevational view of one embodiment in accordance with the present invention with parts thereof displaced prior to compressing material, shown therebetween.

Referring now to the drawings, FIG. 1 shows an apparatus 100 for use in removing liquid, including, for example, water, from a compressible porous material, including, for example, paper, designated 10, such being positioned intermediate a first jaw-abutment 20 and a second jaw-abutment 30. Jaw-abutment 20 and 30 include respectively working faces 21 and 31 and apertures 22 and 32 therethrough, clearly seen in FIG. 1. In this embodiment, jaw-abutment 20 is positioned vertically above jaw-abutment 30, jaw-abutment 20 being adapted to move toward and away from jaw-abutment 30 by means (not shown) and which, for example, may comprise a power cylinder. Alternatively, jaw-abutment 30 could be adapted to move toward and away from jaw-abutment 20 or for both jaw-abutments to move toward and away from one another.

Felt or the like absorbent material 11 extends on opposite sides of material 10, covering respectively the outer opposite surfaces of material 10, and as is evident, contactable with working surfaces 21 and 22 when jaw-abutments 20 and 30 are brought into a closing position.

In this embodiment, apertures 22 and 32 are completely aligned with each other. Thus, when working surfaces of jaw-abutments 20 and 30 are compressing materials 10 and 11 together, a plurality of passages are provided, each passage comprising aperture 22 and an aperture 32 interrupted by materials 10 and 11. Adjacent one common end of the passages, i.e., apertures 22, there is provided a chamber 23 communicating with a compressed air supply passage 24 which is in turn connected to a compressed air supply (not shown). It is visualized that a gas other than air might be used for present purposes, such being selected from those having improved drying qualities and deemed well known to those skilled in the art to which the present invention is directed. Further, gaseous fluids might be applied.

Jaw-abutment 30 includes a drainage chamber 33 for use in draining fluid expressed from materials 10 and 11, as better understood from the description hereinafter.

Regarding operation of apparatus 100, jaw-abutments 20 and 30 are moved apart as seen in FIG. 1, and materials 10 and 11 arranged in the afore-mentioned manner are statically deposited there-between. Jaw-abutment 20 is then moved toward jaw-abutment 30 to compress materials 10 and 11. With compression of materials 10 and 11 taking place, compressed air is introduced to apertures 22 via passage 24 and chamber 23. The compressed air thence passes downwardly of apertures 22 through materials 10 and 11 and downwardly of apertures 32 to exhaust into chamber 33. As will be realized, liquid moisture in materials 10 and 11 will be carried into chamber 33 and expelled therefrom via outlet 34. As will be further realized, the degree of compression, the length of time compression is maintained, and the pressure of the compressed air, may be varied as may be the size and density of the apertures in the working surfaces 21 and 31. All will, of course, be determined by the requirements to be achieved, taking into account the type of materials to be processed.

As may be still further realized, should it be particularly necessary, jaw-abutments 20 and 30 may be arranged whereby the central axis 35 lies in, for example, a horizontal plane rather than a vertical plane, seen in FIG. 1. Such arrangement would thus accommodate materials 10 and 11 suspended in a vertical plane. In such instance, outlet 34 would, of course, be arranged to lie vertically below the central axis 35 to ensure proper drainage of the expressed fluid.

As may be further realized from the afore-mentioned operation, liquid in the material is "pushed" rather than "pulled" from the material to be treated, as in the case of the operation of the prior art devices. This accordingly results in a much more efficient operation, apart from avoiding the afore-mentioned high energy costs associated with evaporative drying.

Turning now to the further embodiment of the invention disclosed, i.e., shown in FIGS. 2 and 3 and depicted as apparatus 150, as seen, the cooperatively arranged pair of abutments in this case comprise a pair of rotatably mounted rollers 40 and 50, and as further seen in FIG. 2, positioned one to another to provide a nip therebetween through which material 10 and 11 is propelled by rollers 40 and 50, the latter being powered by suitable known means (not shown). Although roller 40 is disposed vertically above roller 50, it is contemplated, as in the case of apparatus 100, that materials 10 and 11 comprising webs may extend to travel in a vertical direction, in which case rollers 40 and 50 would be mounted about a substantially horizontal axis, and in such instance, the drainage chamber outlet would be modified to suit, providing efficient drainage.

In the FIG. 2 embodiment, a statically arranged chamber 42 is provided within roller 40 and extends adjacent one aperture 41. Chamber 42 is, in effect, an elongated chamber extending adjacent a plurality of apertures 41, extending lengthwise of roller 40 (not shown). Chamber 42 is interconnected to a compressed air supply (not shown). As noted from FIG. 2, the housing of chamber 42, designated 43, includes a convex face 44 mating with inner concave face 45 of roller 40 in sliding engagement therewith. Thus, when roller 40 is rotatably positioned as shown in FIG. 2, chamber 42 connects fully with an aperture 41 (and the others not shown), and as roller 40 is rotated in either a clockwise or counterclockwise direction, chamber 42 will fully communicate with further apertures 41 in turn. Chamber 42, as seen in FIG. 2, is thus remote from working surface 46 of roller 40.

A statically arranged drainage chamber 52, mentioned above, is provided within roller 50 and extends adjacent a plurality of apertures 51. As in the case of chamber 42 mentioned above, chamber 52 is an elongated chamber extending lengthwise of roller 40. Chamber 52 is interconnected to a drain line (not shown) for removing liquid expressed from materials 10 and 11 during compression by rollers 40 and 50. Chamber 52 is substantially U-shaped and includes a pair of outer ends 53 which are convex to slidably and matingly engage the concave inner surface 54 of roller 50. Chamber 52 could also be connected to a vacuum source in order to increase the pressure differential.

As indicated, rollers 40 and 50 may be mounted for movement toward and away from one another so as to provide the two positions shown respectively in FIGS. 2 and 3. Any well-known arrangement may be utilized for this, being ones deemed well known to those skilled in the art to which the present invention is directed.

Regarding operation of apparatus 150, the paper web 10 and felts 11 are passed between rollers 40 and 50 and thereafter propelled therebetween by powered rotation of either or both of rollers 40 and 50 (FIG. 2). With the compression of web 10 and felts 11 at the nip by the rollers 40 and 50, compressed air is introduced to apertures 41 via chamber 42. The compressed air then passes downwardly through apertures 51 to exhaust into chamber 52, having passed through web 10 and felts 11. Liquid moisture in web 10 and felts 11 is thus carried into chamber 52 and is thereafter expelled therefrom via a drainage outlet (not shown). Thus, apparatus 150 operates much like apparatus 100 to remove water from paper web 10 and felts 11. Again, as in the case of the FIG. 1 embodiment, this embodiment utilizes felt 11 on opposite sides of web 10.

Figure 4:
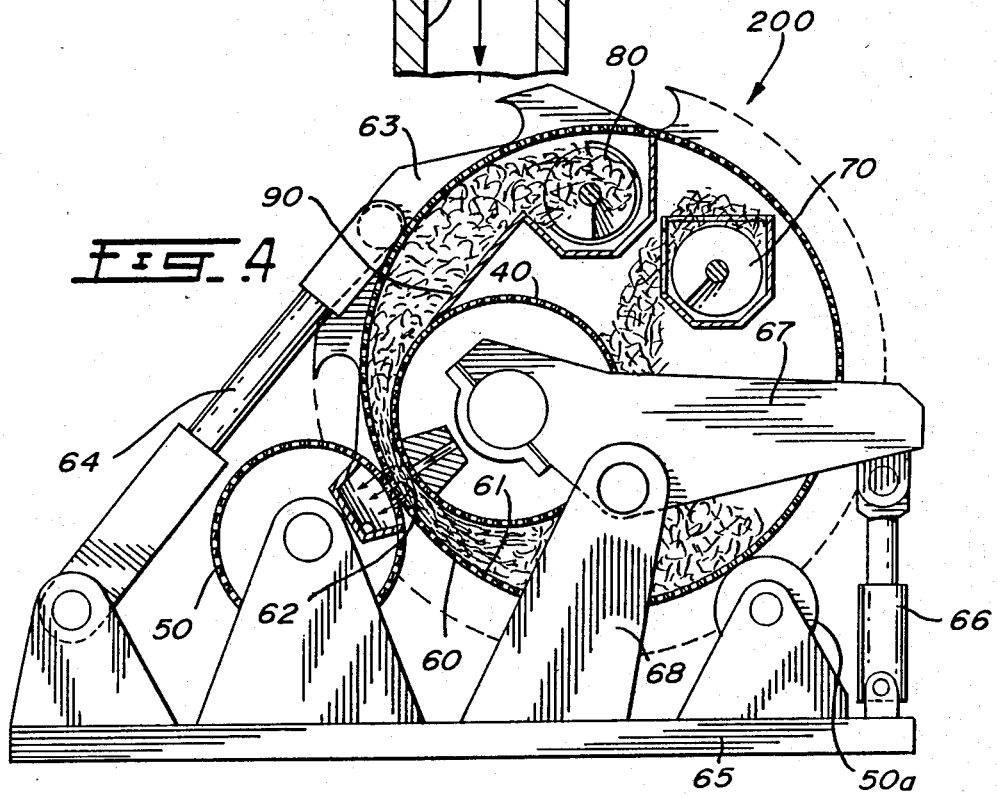
FIG. 4 is a sectioned elevational view showing a further embodiment in accordance with the present invention.

As will be seen in FIG. 4, an apparatus 200 is disclosed somewhat similar to that of FIGS. 2 and 3 in that it includes the pair of rollers 40 and 50 having respectively chambers 42 and 52 therein, and the web passing intermediate the rollers. The main differences from that of the FIGS. 2 and 3 embodiment, of course, include that the plane passing through the axes of rollers 40 and 50 lies at an angle respective the vertical plane. As will be appreciated, this is not important but is convenient since it provides a compact and tidy design.

Conveyor means 60 comprises an annular material support surface 61 having a plurality of apertures 62 therein to permit the compressed air to pass from roller 40 to roller 50 through the material to be dried in similar manner as aforedescribed. As will be noted, annular conveyor means 60 is rotatably supported upon roller 50 and a second roller 50*a*. Rotation is effected through the known ratchet arrangement 63 operated through a power cylinder 64 secured to a base 65, which serves to support rollers 50 and 50*a*.

Movement of roller 40 toward and away from roller 50 is controlled by power cylinder 66 secured to base 65 operating through link arm 67 pivotally mounted to base 65 via support 68. Thus, cylinder 66 controls the degree of the compression of the material intermediate rollers 40 and 50, i.e., at the nip thereof.

Apparatus 200 further includes a material infeed arrangement 70 and a material outfeed arrangement 80, comprising screw conveyors. A material guide plate 90 extends intermediate roller 40 and outfeed arrangement 80 for use in guiding the dried material to outfeed arrangement 80.

Material to be dried is fed to annular support surface 61 via infeed arrangement 70. Operation of ratchet arrangement 63 via cylinder 64 rotates the annular support surface 61, introducing the material to the nip of rollers 40 and 50, which is adjusted through operation of cylinder 66 to provide the desired compression of the material. During the compression, compressed air is introduced to the material via chamber 42 of roller 40 and thereafter subsequently received by chamber 52 of roller 50, in similar manner aforedescribed. Following passage through rollers 40 and 50, the material is advanced via guide 90 to outfeed arrangement 80.

Although apparatus 200 discloses the use of an annular conveyor, it will be readily appreciated that such may be modified to accommodate in place thereof, a linear type conveyor, the material supporting surface of which corresponds to that of apparatus 200, for use in advancing the material to be treated through the nip of rollers 40 and 50. In the case of such modification, rollers 50 and 50*a* may be utilized to support the linear conveyor which would, in effect, comprise a perforated belt. Such modification may also include disposing rollers 40 and 50 one above the other, as per that of apparatus 150. In such modified embodiment, power cylinder 64 and ratchet arrangement 63 would be dispensed with and material infeed arrangement 70 and material outfeed arrangement 80 could be repositioned adjacent respective ends of the linear conveyor. Again, as in the case of apparatus 150, rollers 40 and 50 may be arranged for registered or non-registered movement, one to another.

From the foregoing, it will be seen that during operation, the materials are compressed, preferably using a maximum compressive force in keeping with permitted conditions. Further, the compacted material, in the case of the embodiments disclosed, is a formed sheet of paper which is saturated with water, that a felt web is used on opposite sides of the formed paper and that the compressed fluid used is air which is forced through the formed sheet. It is to be noted that, during such operation, additional water will not only be expressed from the pores in the paper sheet, but water in the felt adjacent the paper sheet will also be expelled into the receiving chambers of the apparatus. The net result of this is that, at maximum compaction, the water content of the sheet is less than the theoretical limitation which applies to current wet pressing operations and that by expelling water from the felt adjacent the paper sheet, the "rewetting" phenomenon is greatly reduced.

Figure 2C:
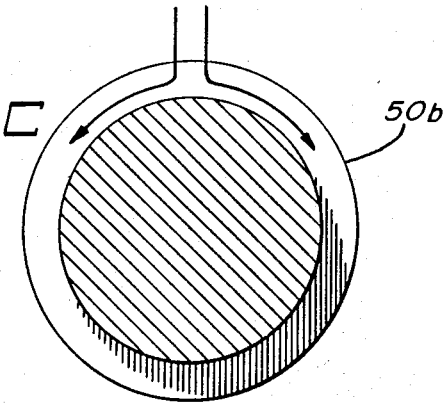
FIG. 2*c* is a sectioned view of the alternative component shown in FIG. 2*b;*

Apparatuses 100, 150, 200 and, of course, others not shown but in accordance with the present invention, may, if desired, be modified, particularly in terms of the drainage abutment. Reference is made to FIG. 2*b* showing vented nip type roller 50*b*. Roller 50*b* may be used in place of roller 50 with its accompanying chamber 52. In such case, the grooves 50*c* serve the same function as that provided by apertures 51 and chamber 52 To explain, the compressed air, following passage through the material and felt, enters groove or grooves 50*c* adjacent the working surface of roller 50*b*, carrying the expressed fluid therewith; thereafter such is exhausted in lengthwise direction of the grooves 50*c*, as best seen in FIG. 2*c* indicated by the arrows. The expressed fluid may be subsequently collected in suitable means (not shown).

Figure 5:
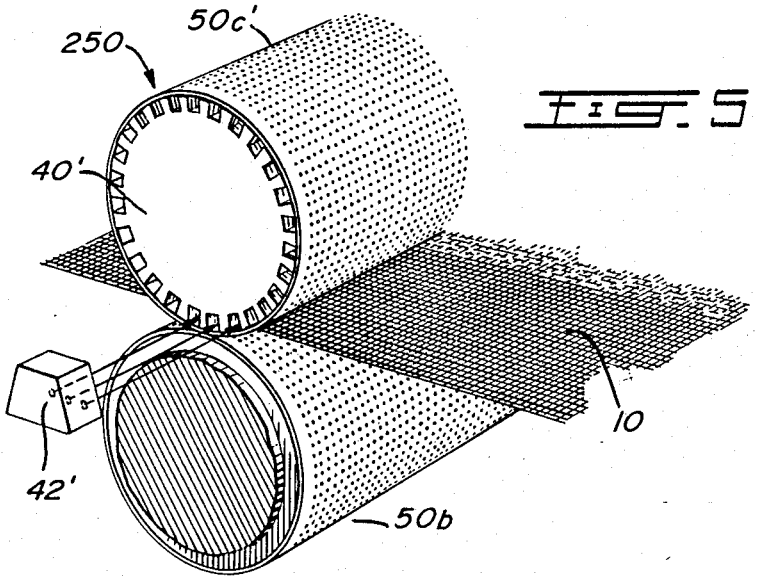
FIG. 5 is a perspective view of a further embodiment in accordance with the present invention.

Reference is made to FIG. 5 showing further apparatus 250, according to the invention. Apparatus 250 includes roller 50*b* and accordingly grooves 50*c* and also includes an abutment roller 40' having elongated grooves 50*c'* similar to those of roller 50*b* but extending in axial direction thereof As seen, rollers 50*b* and 40' provide a nip similar to that of the other aforedescribed embodiments. Additionally, apparatus 250 includes a chamber 42' which is connected to a compressed air supply (not shown), chamber 42' thus being for use in supplying compressed air or gas in a direction along grooves 50*c'*, which air or gas is exhausted after passing through paper 10 via grooves 50*c*, lengthwise thereof.

As in the case of the other roller embodiments described, rollers 50*b* and 40' are positioned or are positionable to provide a nip through which the material to be compressed passes when propelled therethrough. Chamber 42' includes nozzle means (not shown) for directing the compressed air or gas along one or more of grooves 50*c'*, at a given time. If desired, a second chamber 42' may be situated at the opposite end of roller 40' to thus introduce compressed air or gas from both ends of the roller 40' and thus increase the amount of compressed gas or air passing along grooves 50*c'* and passing through material 10.

Figure 5A:
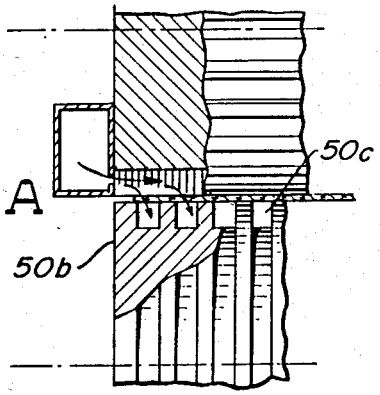
FIG. 5*a* is a part sectional view of FIG. 5.

In further reference to operation of the FIG. 5 embodiment, reference is made to FIG. 5*a* showing the passage of the compressed gas or air passing along an axially extending groove 50*c'* of roller 40' to exit through material 10 and thereafter along the circumferentially extending groove 50*c* of roller 50*b*.

As indicated previously, the compressed gas or air may be discharged along one or more of the longitudinally extending grooves 50*c'* of roller 40', i.e., at the formed nip.

Figure 6:
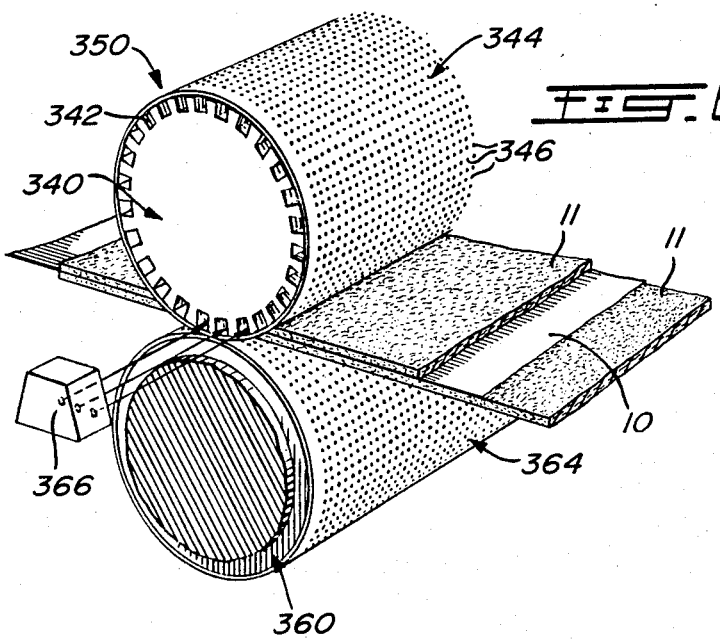
FIG. 6 is a perspective view, partly broken away, similar to FIG. 5, showing a still further embodiment of the present invention.
Figure 7:
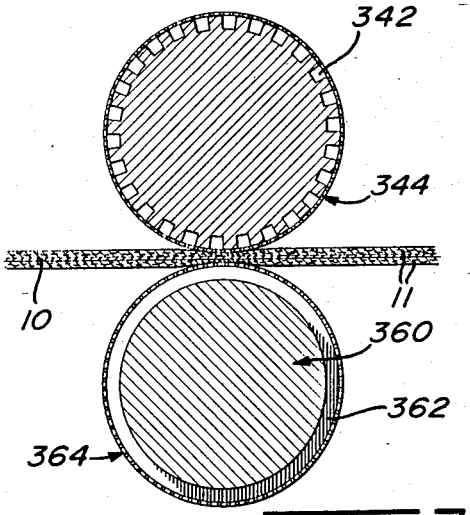
FIG. 7 is an end elevation of the embodiment shown in FIG. 6.

The pair of rollers 350, shown in FIG. 6, include a core roller 340 provided with axial grooves 342 similar to those grooves illustrated in FIG. 5. Surrounding the roller 340 is a sleeve 344 having a plurality of apertures 346. Thus, as shown in FIG. 7, the axial groove 342 covered by the sleeve 344 provides separate elongated plenums or chambers with nozzles in the form of apertures 346. In FIGS. 6 and 7, the web of paper is identified by the numeral 10 as are the felts 11 sandwiching the web 10. A roll 360 is located in vertical alignment and parallel relationship with the roll 340. The roll 360 has circumferential grooves 362 similar to grooves **50*b* in FIG. 5. Roll 360 is also covered by a sleeve 364. Sleeve 364, which is similar to sleeve 344**, is provided with innumerable apertures.

When the two rolls are pressed against each other and compressed air is fed from unit 366 endwise through the chambers formed by the grooves 342, the compressed air passes through the so-formed nozzles 346 through the felts 11 and paper web 10 to be discharged with the displaced water into the grooves 362 within the sleeve 364. The plurality of apertures 346 allow the water being displaced to enter within the discharge grooves 362. The water is then drained from the roll 360 by centrifugal force.

We claim:

1. In the press section of a papermaking machine comprising a pair of paper machine felts for advancing a web of paper being formed, a dewatering apparatus consisting only of a pair of opposed press rolls in an environment at atmospheric pressure, the press rolls being provided one on either side of the felts forming a nip, means pressing the rolls towards each other at the nip to press the felts and the paper web to a maximum mechanical compression, means for providing an air flow across the nip, including means for supplying compressed air only to one of the rolls and exhaust means at the other of the rolls, said means for supplying compressed air only to one of the rolls being located by said one roll for supplying air under pressure across the roll at the nip, said one roll being in the form of a solid roll having grooves on the periphery thereof, wherein said one roll has axial parallel grooves extending axially of said one roll, and said means for supplying compressed air being located adjacent at least one end of said one roll for passing air through the peripheral axial grooves which form plenums therefor; and exhaust means located at the other of the rolls for draining water and receiving air across the roll at the nip such that the pores of the felt and the web of paper at the nip are being flushed of water displaced by the air being forced through at the nip and whereby, when the felts and the web of paper have passed the nip and into an atmospheric pressure environment, the water content of the felts and the web will have been greatly reduced, whereby the air is passed under pressure at the nip so formed to thereby evacuate water from the pores of the compressed felts and web at the nip and that as the felts and web exit from the nip at atmospheric pressure, the paper web remains substantially free of water.

2. An apparatus as defined in claim 1, wherein the other of the rolls is a solid roll with peripheral grooves thereon, said peripheral grooves extending circumferentially around the other of the rolls and in the direction of travel of the felts and the web of paper, said grooves on the other of said rolls being sufficient to provide said exhaust means and drainage for the water and air passing through the felts and the web of paper.

3. An apparatus as defined in claim 2, wherein each roll is provided with a circumferential sleeve which is perforated to provide a plurality of apertures communicating with the respective grooves.

* * * * *